US007044899B2

(12) United States Patent
Kuo

(10) Patent No.: US 7,044,899 B2
(45) Date of Patent: May 16, 2006

(54) MINI-TYPE EXERCISE MACHINE

(76) Inventor: Johnson Kuo, 11F-1C, No. 342, Keelung Rd., Sec. 1, Taipei (TW)

( * ) Notice: Subject to any disclaimer, the term of this patent is extended or adjusted under 35 U.S.C. 154(b) by 387 days.

(21) Appl. No.: 10/678,264

(22) Filed: Oct. 6, 2003

(65) Prior Publication Data

US 2005/0075226 A1 Apr. 7, 2005

(51) Int. Cl.
*A63B 21/04* (2006.01)
*A63B 21/055* (2006.01)

(52) U.S. Cl. ..... 482/121; 482/123; 482/130; 482/138

(58) Field of Classification Search ..... 482/121, 482/123, 130, 137, 138, 140; D21/676
See application file for complete search history.

(56) References Cited

U.S. PATENT DOCUMENTS 5,215,511 A * 6/1993 Cheng ..... 482/121
D349,140 S * 7/1994 Rockwell ..... D21/674
5,387,171 A * 2/1995 Casey et al. ..... 482/130
5,393,286 A * 2/1995 Cheng ..... 482/130
6,152,866 A * 11/2000 Kuo ..... 482/142
D472,285 S * 3/2003 Kuo ..... D21/676
6,533,710 B1 * 3/2003 Lin et al. ..... 482/123
6,872,170 B1 * 3/2005 Kuo ..... 482/71
2002/0173412 A1 * 11/2002 Stearns ..... 482/123

* cited by examiner

*Primary Examiner*—Jerome Donnelly
*Assistant Examiner*—Victor K. Hwang
(74) *Attorney, Agent, or Firm*—Browdy and Neimark, PLLC

(57) ABSTRACT

A mini-type exercise machine includes a base, a T-shaped strut pivotably connected to a front end of the base, a seat assembly mounted on the base, a pressing member pivotably connected to the seat assembly, and at least one damper mounted on each of the T-shaped strut and the pressing member for providing a resistance while any of the T-shaped strut and the pressing member pivots. The mini-type exercise machine of the present invention can be operated to perform various types of exercise so as to have multiple exercise effects by means of the T-shaped strut and the pressing member. In addition, the present invention is partly detachable and easily collapsible, such that the present invention can be partly dismantled into small parts and easily collapsed to be small-sized, thereby enabling the present invention to be easily pocketable.

11 Claims, 8 Drawing Sheets

MINI-TYPE EXERCISE MACHINE

BACKGROUND OF THE INVENTION

1. Field of the Invention

The present invention relates generally to exercise equipments, and more particularly, to a mini-type exercise machine.

2. Description of the Related Art

There are many kinds of conventional exercise equipments which are commercially available, like multi-functional exercisers, rowing machines, jogging machines, etc., for strengthening specific portions of muscle or muscle endurance. Because there is not too much space in most of families at present, the exercise equipments are developed to be compact, small-sized, and user-friendly. However, each of the small-sized exercise equipments is to strengthen a specific portion of muscle to have single exercise effect. When the user intends to strengthen another portions of muscle, the user has to buy another exercise equipments. Hence, many exercise equipments are purchased and placed indoors to cost more money and to occupy much space as those large-sized multi-functional exercise equipments do.

SUMMARY OF THE INVENTION

The primary objective of the present invention is to provide a mini-type exercise machine which is structurally single and can be operated to perform various kinds of exercise to have multiple exercise effects.

The secondary objective of the present invention is to provide a mini-type exercise machine which can be easily collapsible to be conveniently pocketable.

The foregoing objectives of the present invention are attained by the mini-type exercise machine which is composed of a base, a T-shaped strut pivotably connected to a front end of the base, a seat assembly mounted on the base, a pressing member pivotably connected to the seat assembly, and at least one damper mounted on each of the T-shaped strut and the pressing member for providing a resistance while any of the T-shaped strut and the pressing member pivots. The mini-type exercise machine of the present invention can be operated to perform various types of exercise so as to have multiple exercise effects by means of the T-shaped strut and the pressing member. In addition, the present invention is partly detachable and easily collapsible, such that the present invention can be partly dismantled into small parts and easily collapsed to be small-sized, thereby enabling the present invention to be easily pocketable.

DETAILED DESCRIPTION OF THE INVENTION

Figure 1:
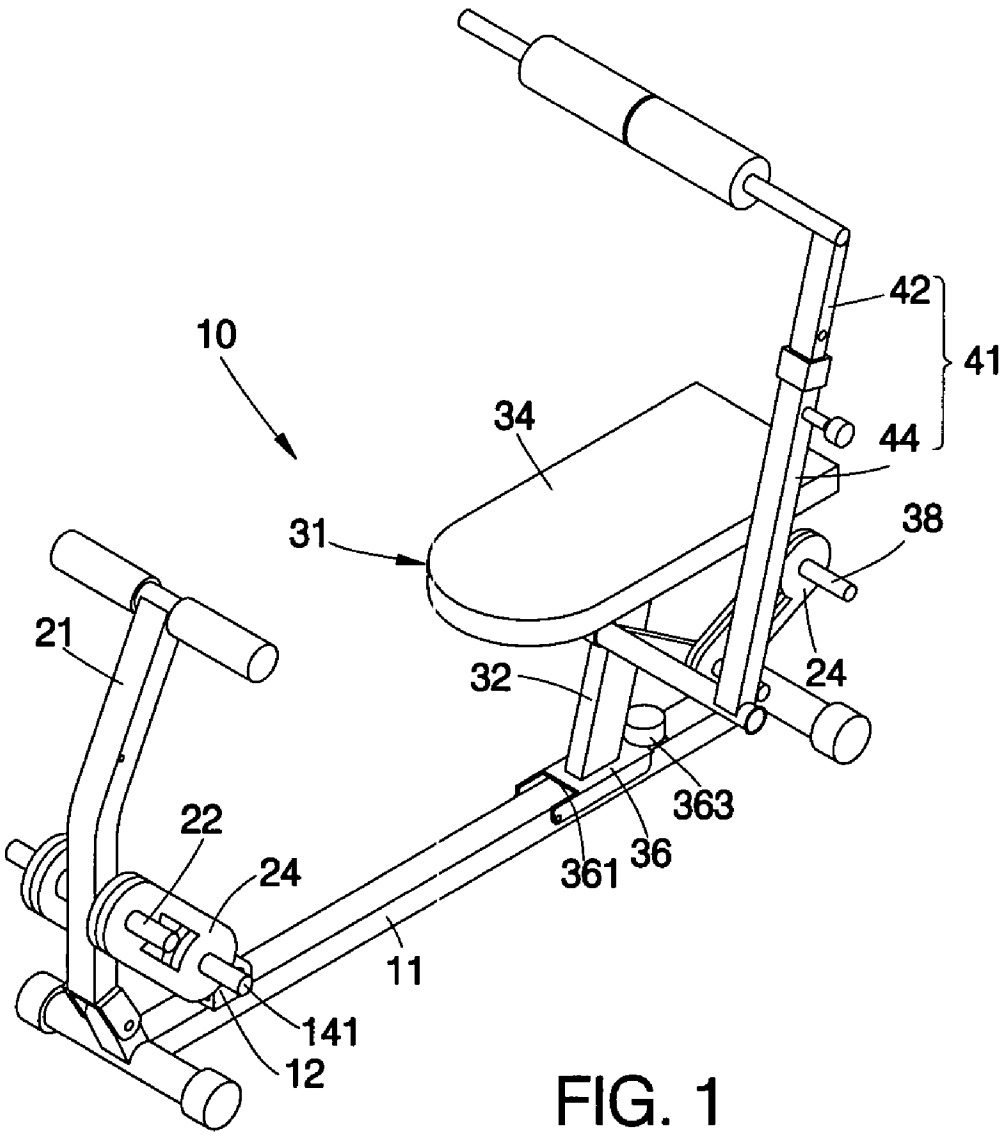
FIG. 1 is a perspective view of a preferred embodiment of the present invention.
Figure 2:
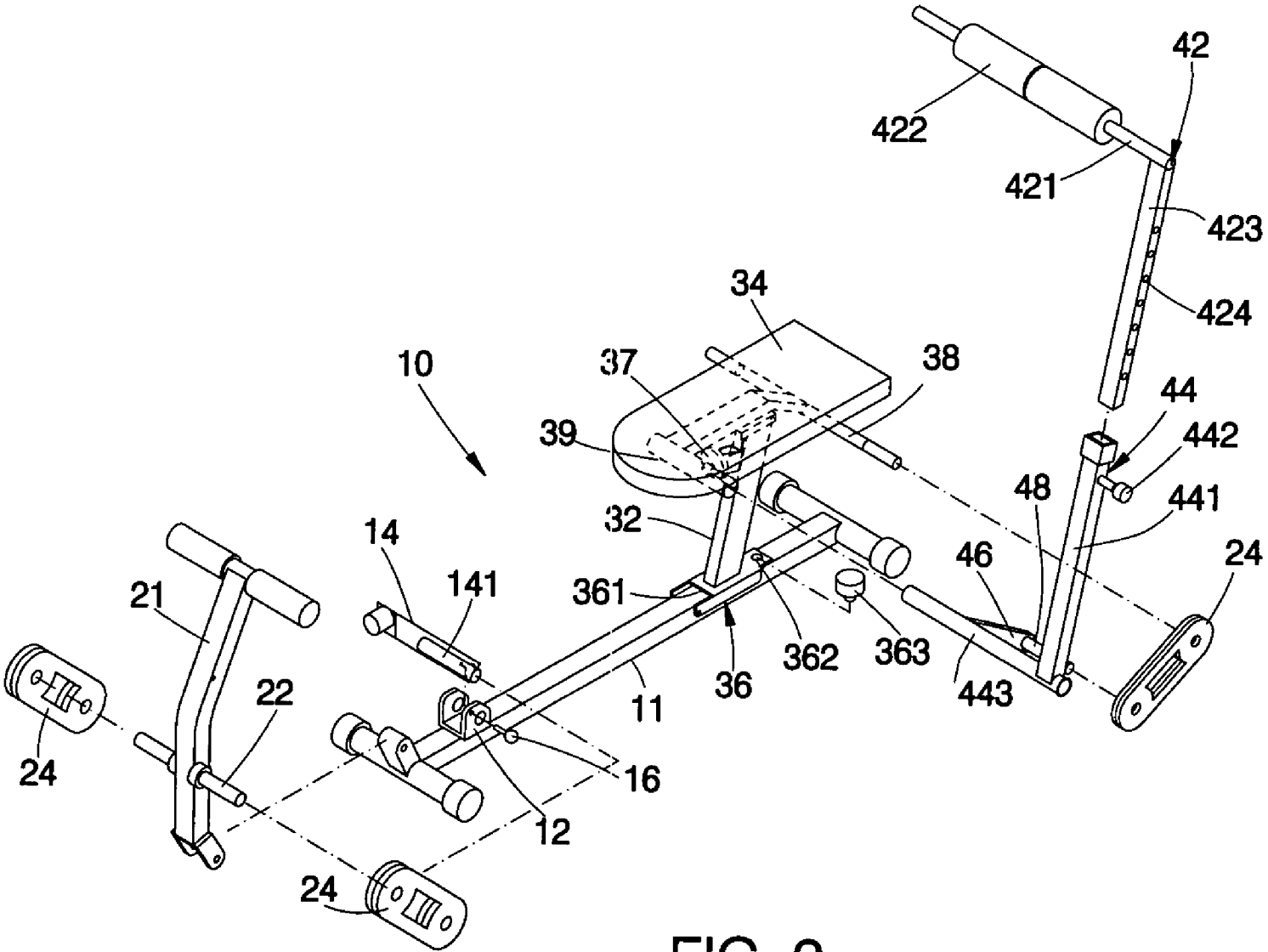
FIG. 2 is an exploded view of the preferred embodiment of the present invention.

Referring to FIGS. 1 and 2, a mini-type exercise machine 10 constructed according to a preferred embodiment of the present invention is composed of an I-shaped base 11, a T-shaped strut 21, a seat assembly 31, and a pressing member 41.

The base 11 includes a pivot mount 12 mounted on a front section thereof, a supporting bar 14 pivotably connected to the pivot mount 12, and a first transversal bar 141 extending sidewards from bilateral sides of a middle section of the supporting bar 14. A fastener 16 is inserted through the supporting member 14 and the pivot mount 12 to hold the supporting member 14 at an angle.

The T-shaped strut 21 includes a second transversal bar 22 at a lower section thereof and is pivotably connected to a front top end of the base 11 at a distal end thereof. The supporting bar 14 holds a rear side of the T-shaped strut 21 to enable the T-shaped strut 21 to pivot forwards only. At least one damper 24 is mounted on the first and second transversal bars 141 and 22 for providing a resistance against which the user can exercise while the T-shaped strut 21 pivots forwards.

The seat assembly 31 is composed of a seat strut 32, a seat cushion 34, and a seat mount 36 fixed to a bottom end of the seat strut 32. The seat mount 36 is pivotably mounted on a middle-rear section of the base 11 at bilateral sides of a front end thereof and has a gap 361 formed at the front end thereof and a through hole 362 formed at a rear end thereof. A locking member 363 is threadedly inserted into the through hole 362 to secure the seat strut 32 to the base 11. The seat cushion 34 is pivotably connected to a top end of the seat strut 32 to pivot and is threadedly secured to the seat strut 32 by a bolt 37. The seat assembly 31 further includes a first lateral bar 38 extending sidewards below a rear end of the seat cushion 34 and a tubular member 39 mounted below a front end of the seat cushion 34.

The pressing member 41 is composed of a first pressing bar 42 and a second pressing bar 44. The first pressing bar 42 includes an upper portion 421 and a lower portion 423, and the second pressing bar 44 includes a hollow longitudinal portion 441 and a transversal portion 443. The first pressing bar 42 is disposed with a cushion 422 at the upper portion 421 thereof and is provided with a plurality of positioning holes 424 at the lower portion 423 thereof. The lower portion 423 of the first pressing bar 42 is coupled with the longitudinal portion 441 of the second pressing bar 44. A pin 442 which is disposed on the longitudinal portion 441 of the second pressing bar 44 is inserted into one of the positioning holes 424 of the lower portion 423 of the first pressing bar 42 to enable the first and second pressing members 42 and 44 to be adjustably secured to each other, such that the user can adjust the elevation of the pressing member 41 relatively to the seat cushion 34. The transversal portion 443 of the second pressing bar 44 is coupled with the tubular member 39 at a distal end thereof. The transversal portion 443 of the second pressing bar 44 has a linkage 46 extending rearwards from a middle section thereof. The linkage 46 has a second lateral bar 48 extending sidewards therefrom. At least one damper 24 is connected between the first lateral bar 38 of the seat cushion 34 and the second lateral bar 48 of the second pressing bar 44 for generating a resistance against which the user can exercise while the pressing member 41 is operated to pivot rearwards.

Figure 3:
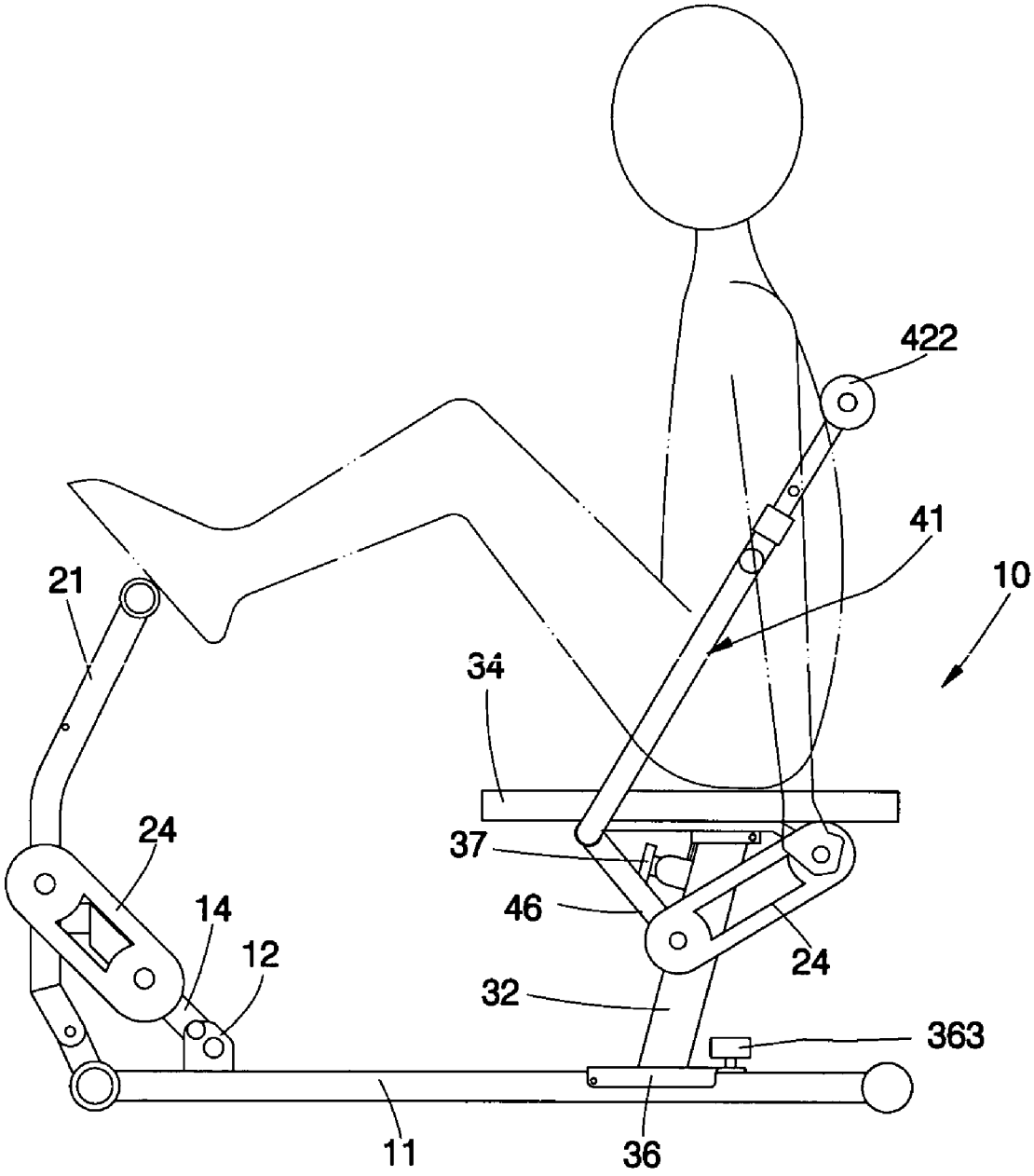
FIGS. 3 and 4 are side views of the preferred embodiment of the present invention, showing that the present invention is operated.
Figure 4:
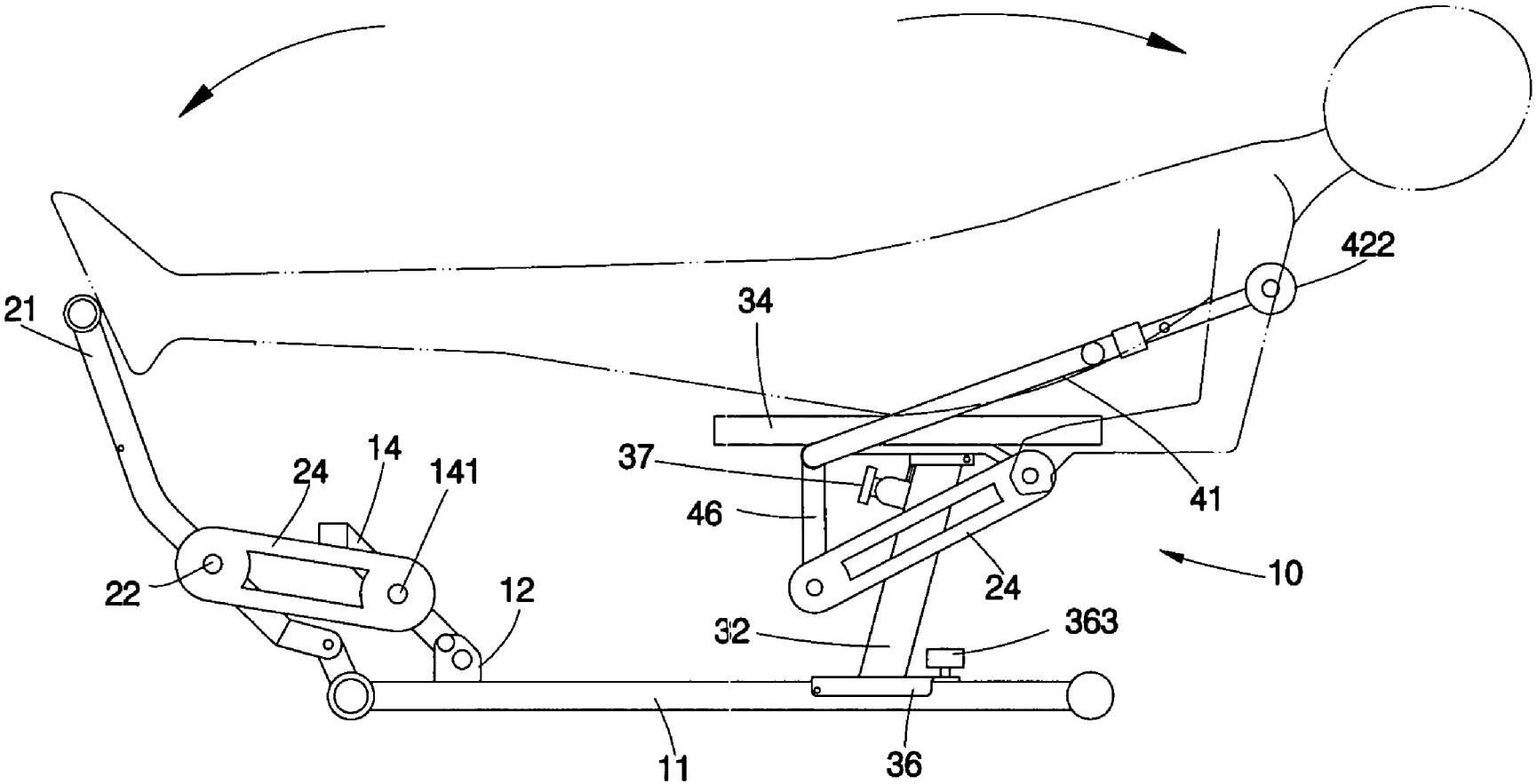

Referring to FIG. 3, while the user sits on the seat cushion 34, the two feet step on bilateral sides of a top end of the T-shaped strut 21 and the back lies against the cushion 422 of the pressing member 41. Then, push forwards against the T-shaped strut 21 by the two feet and push backwards against the pressing member 41 by the back, as shown in FIG. 4. Meanwhile, the dampers 24 are pulled respectively by the second transversal bar 22 of the T-shaped strut 21 and the linkage 46 of the pressing member 41 to extend to provide the resistance while the pressing member 41 is operated to pivot rearwards, thereby enabling the user to strengthen the muscle of the legs and the back at the same time.

Figure 5:
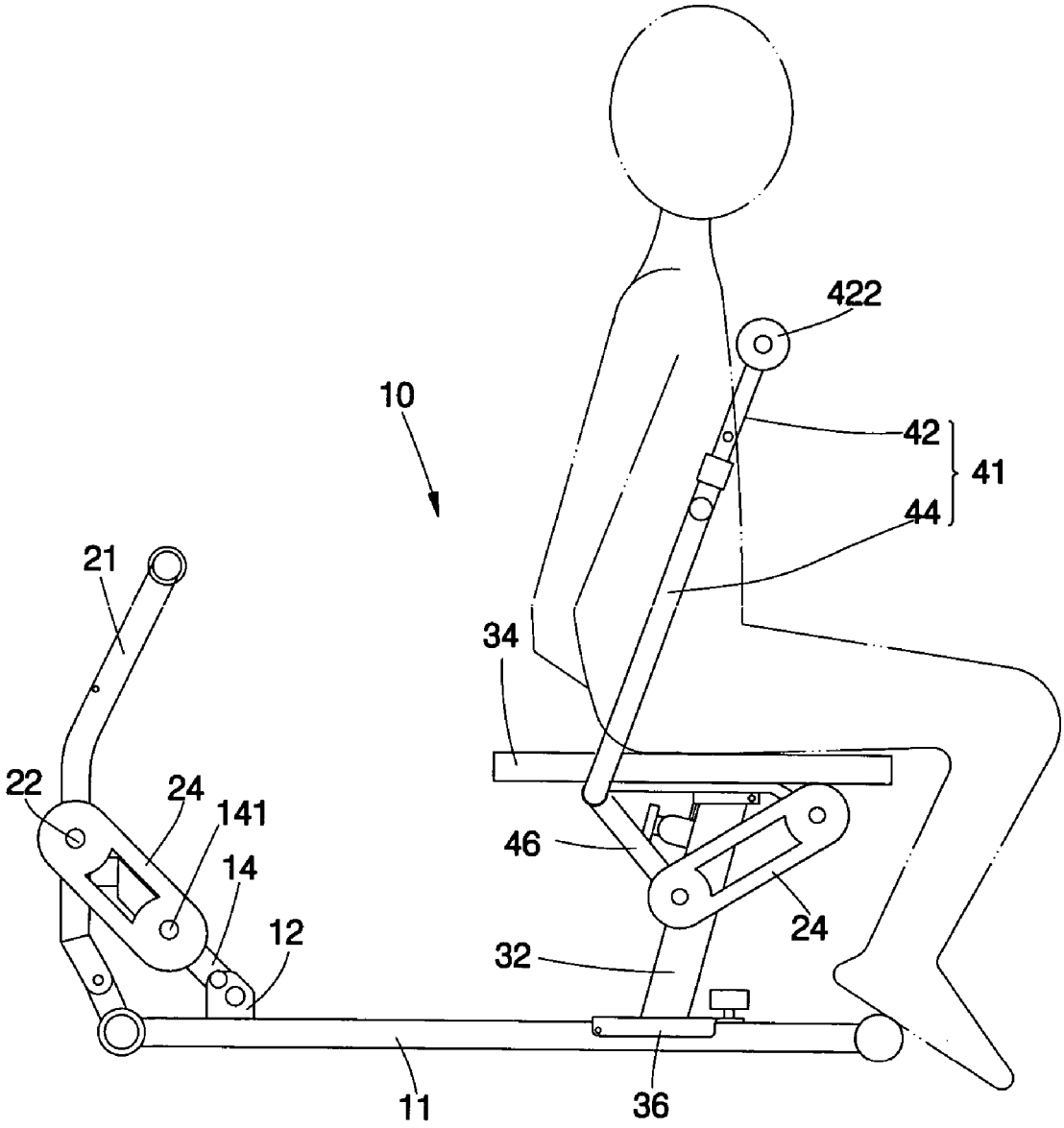
FIGS. 5 and 6 are another side views of the preferred embodiment of the present invention, showing that the present invention is operated.
Figure 6:
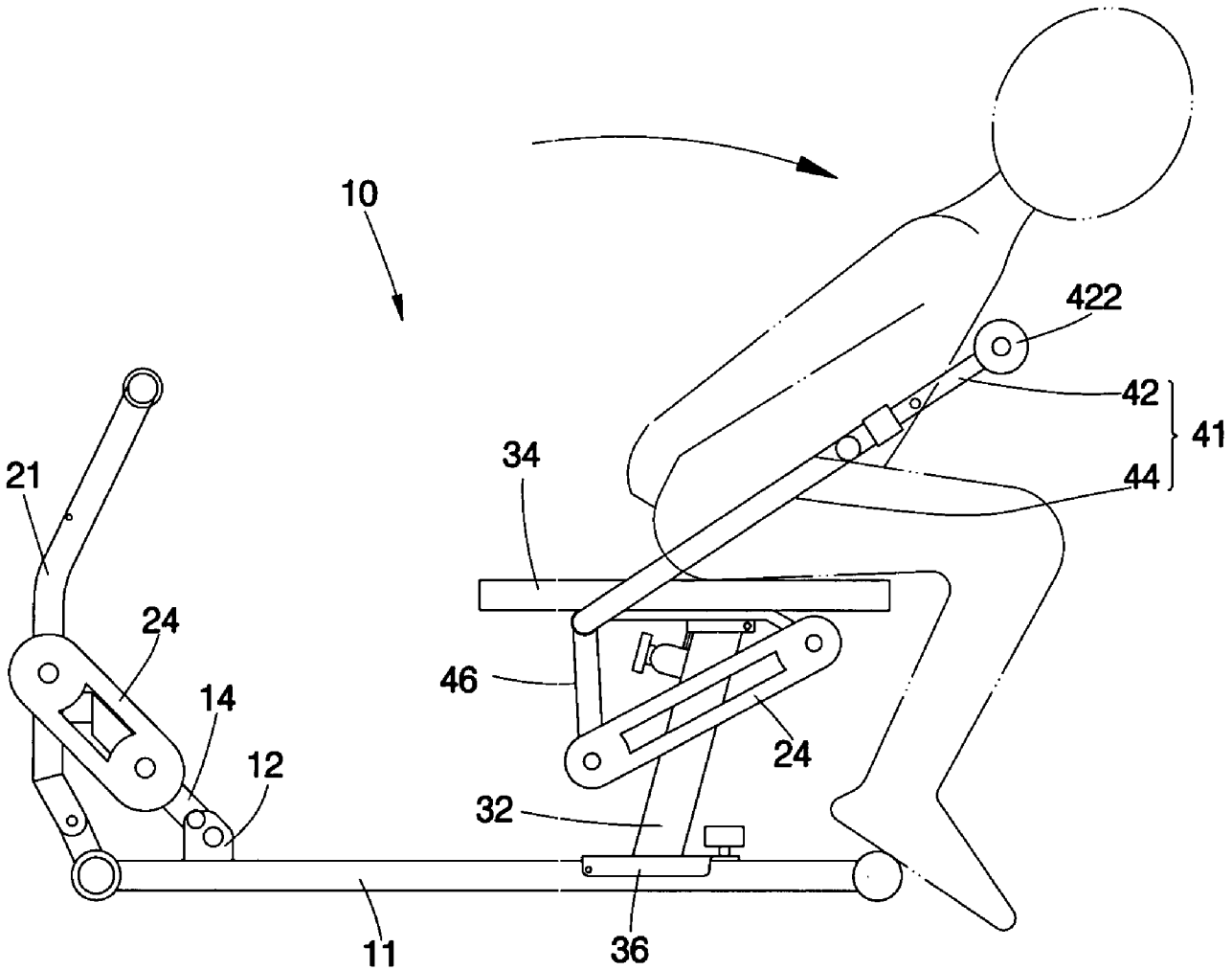

Referring to FIGS. 5 and 6, the user can alternatively sit on the seat cushion 34 of the mini-type exercise machine 10 in a converse direction with the chest thereof contacting against the cushion 422 of the pressing member 41, and further enable the chest to oppress downwards against the pressing member 41. When the pressing member 41 is oppressed to pivot downwards, the linkage 46 is caused to pivot so as to cause the extension of the damper 24, such that the user can exercise against the resistance generated by the damper 24 to further strengthen the muscle of the user's abdomen and waist.

Figure 7:
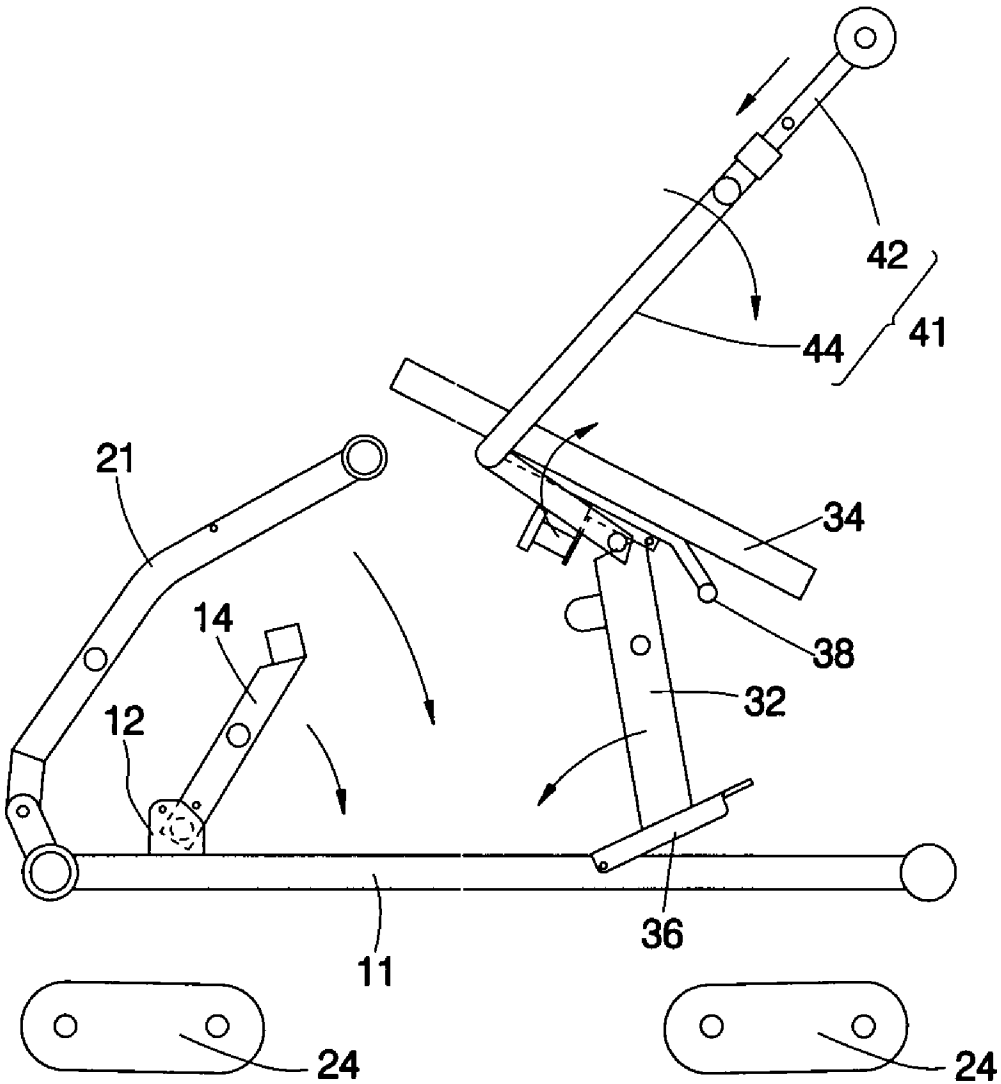
FIGS. 7 and 8 are side views of the preferred embodiment of the present invention, showing that the present invention is partly dismantled and fully collapsed.
Figure 8:
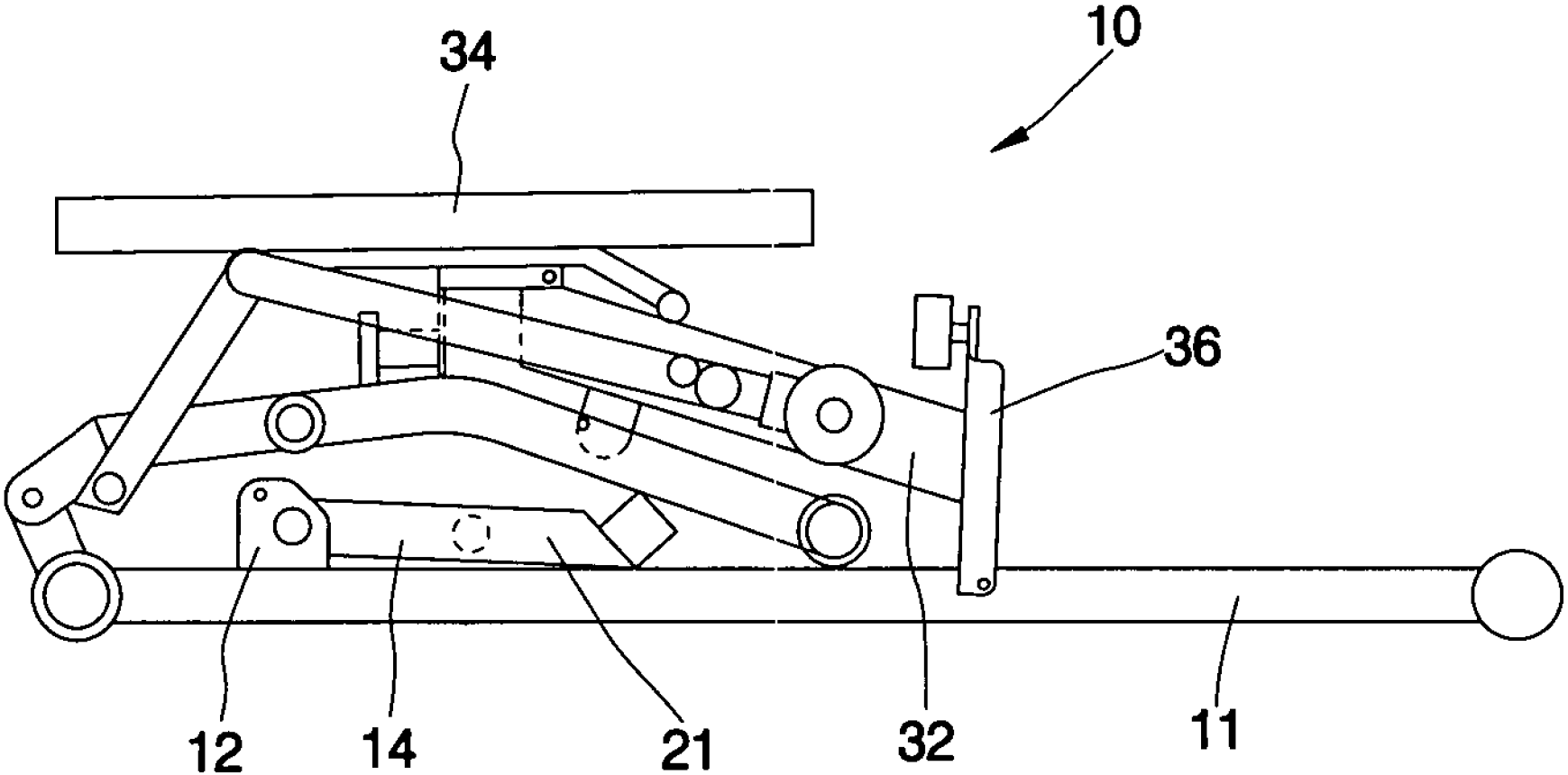

Referring to FIGS. 2 and 7, while intending to dismantle the present invention, firstly, detach the dampers 24 and remove the fastener 16 from the supporting bar 14 and the pivot mount 12; meanwhile, the supporting bar 14 can be put to pivot backwards to lie against the base 11, and the supporting force provided by the supporting bar 14 and the damper 24 is eliminated to cause the T-shaped strut 21 to pivot backwards to lie against the base 11. Next, remove the locking member 363 from the base 11 and the seat mount 36 to unlock the seat strut 32 from the base 11, and then remove the bolt 37 from the seat strut 32 and the seat cushion 34 to unlock the seat cushion 34 from the seat strut 32. In the meantime, the seat mount 36 can be put to pivot forwards, the seat cushion 34 is unlocked to pivot backwards, and the pressing member 41 is also unlocked to pivot to a proper position. Finally, the mini-type exercise machine 10 is completely collapsed and dimensionally reduced to be easily pocketable, as shown in FIG. 8.

Alternatively, the damper 24 can be a rubber tensile piece which has appropriate resilience. The amount of the rubber tensile piece can be adjustably increased according to the user's requirement to further increase the resistance.

In conclusion, the present invention includes advantages as follows.

1. The mini-type exercise machine is structurally single and can be operated to strengthen the muscle of the user's legs, back, and abdomen to render multiple exercise effects.
2. The mini-type exercise machine can be easily assembled, disassembled and collapsible on the user's own and have effectively reduced size while disassembled and collapsed, such that it is convenient to place the exercise machine.

What is claimed is:

1. A mini-type exercise machine comprising:

a base having a pivot mount disposed on a front end thereof and a supporting bar pivotably mounted on said pivot mount;

a T-shaped strut pivotably mounted on an end of said base;

a seat assembly having a seat strut, a seat cushion, a seat mount fixed to a bottom side of said seat strut, and a tubular member, said seat mount being pivotably connected with said base, said seat cushion being pivotably connected to a top end of said seat strut, said tubular member being mounted below said seat cushion;

a pressing member having a first pressing bar and a second pressing bar, said first pressing bar and said second pressing bar being sleeved with each other, said second pressing bar being fitted into said tubular member and having a linkage extending rearwards therefrom; and at least one damper disposed on each of said T-shaped strut and said pressing member to provide a resistance while any of said T-shaped strut and said pressing member pivots.

2. The mini-type exercise machine as defined in claim 1, wherein said supporting bar and said pivot mount are inserted through by a fastener to hold said supporting bar at an angle.

3. The mini-type exercise machine as defined in claim 1, wherein said supporting bar comprises a first transversal bar extending sidewards from bilateral sides of a middle section of said supporting bar.

4. The mini-type exercise machine as defined in claim 1, wherein said T-shaped strut comprises a second transversal bar at a lower portion thereof.

5. The mini-type exercise machine as defined in claim 1, wherein said seat mount of said seat strut is pivotably mounted on a middle-rear section of said base at bilateral sides of a front end thereof.

6. The mini-type exercise machine as defined in claim 1, wherein said seat mount comprises a gap formed at a front end thereof.

7. The mini-type exercise machine as defined in claim 1, wherein said seat mount is threadedly fixed to a rear end thereof by a locking member to secure said seat strut to said base.

8. The mini-type exercise machine as defined in claim 1, wherein said seat cushion comprises a first lateral bar extending sidewards below a rear end thereof.

9. The mini-type exercise machine as defined in claim 1, wherein said linkage of said second pressing bar comprises a second lateral bar extending sidewards.

10. The mini-type exercise machine as defined in claim 1, wherein said first pressing bar comprises a plurality of positioning holes thereon; said second pressing bar comprises a pin disposed thereon for inserting into one of said positioning holes.

11. The mini-type exercise machine as defined in claim 1, wherein said damper is a rubber tensile piece having appropriate resilience.

* * * * *